US008092188B2

(12) United States Patent
Rosati et al.

(10) Patent No.: US 8,092,188 B2
(45) Date of Patent: Jan. 10, 2012

(54) VARIABLE GEOMETRY FAN AND METHOD FOR MANUFACTURING THE BLADES THEREOF

(75) Inventors: Guido Rosati, Turin (IT); Mattia Merlin, Rovigo (IT)

(73) Assignee: Rosati Fratelli S.r.l., Leini (Torino) (IT)

( * ) Notice: Subject to any disclaimer, the term of this patent is extended or adjusted under 35 U.S.C. 154(b) by 538 days.

(21) Appl. No.: 12/350,302

(22) Filed: Jan. 8, 2009

(65) Prior Publication Data

US 2009/0175726 A1 Jul. 9, 2009

(30) Foreign Application Priority Data

Jan. 9, 2008 (IT) ..... TO08A0013
Dec. 24, 2008 (EP) ..... 08172921

(51) Int. Cl.

| | |
|---|---|
| ***F03B 3/12*** | (2006.01) |
| ***F03B 7/00*** | (2006.01) |
| ***B63H 1/26*** | (2006.01) |
| ***B63H 7/02*** | (2006.01) |
| ***B64C 11/16*** | (2006.01) |
| ***B64C 27/46*** | (2006.01) |
| ***F01D 5/14*** | (2006.01) |
| ***F03D 11/02*** | (2006.01) |
| ***F04D 29/38*** | (2006.01) |

(52) U.S. Cl. ..... 416/229 A; 416/223 A; 29/889.71

(58) Field of Classification Search ..... 416/229 A, 416/223 A, 229 R, 230, 232, 224, 240, 39, 416/147, 241 A, 132 A, 135; 29/889.71
See application file for complete search history.

(56) References Cited

U.S. PATENT DOCUMENTS

| | | | | |
|---|---|---|---|---|
| 4,177,012 | A * | 12/1979 | Charles | 416/132 A |
| 4,427,339 | A * | 1/1984 | Witzel | 416/131 |
| 5,570,997 | A * | 11/1996 | Pratt | 416/117 |
| 5,634,771 | A * | 6/1997 | Howard et al. | 416/241 A |
| 5,965,240 | A * | 10/1999 | Blackburn et al. | 428/192 |
| 6,669,444 | B2 * | 12/2003 | Alacqua et al. | 416/132 A |
| 7,300,254 | B2 * | 11/2007 | Kistner et al. | 416/210 R |
| 7,402,025 | B2 * | 7/2008 | Wang | 416/62 |
| 7,931,443 | B1 * | 4/2011 | Potter et al. | 416/224 |

FOREIGN PATENT DOCUMENTS

| | | |
|---|---|---|
| EP | 0 040 532 A1 | 11/1981 |
| EP | 1 247 992 A1 | 10/2002 |
| EP | 1 247 992 B1 | 2/2004 |

* cited by examiner

*Primary Examiner* — Chris Chu
(74) *Attorney, Agent, or Firm* — Heslin Rothenberg Farley & Mesiti P.C.; Victor A. Cardona

(57) ABSTRACT

A fan, particularly for cooling internal combustion engines for earth moving machines, whose blades have an elastically deformable composite structure including at least one shape memory alloy foil adapted to be heated by means of electric current to vary the geometry of the blade.

13 Claims, 4 Drawing Sheets

VARIABLE GEOMETRY FAN AND METHOD FOR MANUFACTURING THE BLADES THEREOF

CROSS REFERENCE TO RELATED APPLICATIONS

This application claims priority from Italian patent application No. TO2008A000013, filed on Jan. 9, 2008, and European Patent Application No. 08172921.2, filed on Dec. 24, 2008, the entire disclosures of which are incorporated herein by reference.

FIELD OF THE INVENTION

The present invention generally refers to fans for cooling internal combustion engines, particularly (though not exclusively) tractors, farm machinery as well as earth moving machines. In applications thus made and for some operation conditions it is necessary to regulate the airflow generated by the cooling fans in such a manner to facilitate removal of sludge and dirt from the engine radiator of such vehicles, in such a manner to restore ideal thermal exchange conditions. In order to attain this, required is the command-controllable variation of the geometric configuration of the blades as well as, for short operation intervals, the possible inversion of the airflow maintaining the direction and speed of rotation of the fan unaltered.

More in particular the invention regards a variable geometry cooling fan, of the type comprising a plurality of blades rotatable around an axis of rotation, wherein the configuration of the blades may be varied by using a shape memory material.

PRIOR ART

Use of shape memory materials to vary the characteristics of the airflow generated by the fan have already been proposed in the variable geometry cooling fans industry. Typically, as described for example in the European patent EP-1247992B1, the blades are connected to a hub through respective shafts made of shape memory material, deformable under thermal effect in such a manner for example to increase their angle of incidence proportionally with respect to the temperature rise.

In other known solutions, like the one described in the European patent application EP-A1-0040532, the blades are entirely and exclusively made up of shape memory material.

However, solutions thus known are scarcely reliable and unsatisfactory from a functional point of view, in particular regarding the mechanical and resistance characteristics of the blades and thus of the fan in its entirety.

SUMMARY OF THE INVENTION

The object of the invention is that of overcoming the above-mentioned drawback and providing a variable geometry fan of the type defined above which is made for attaining even inversions of the generated airflow—in an instantaneous and efficient manner—maintaining the direction and speed of rotation unaltered on one hand, and guaranteeing high mechanical resistance properties even after a long period of use on the other.

According to the invention, such object is primarily obtained due to the fact that the blades of the fan have an elastically deformable composite structure including at least one shape memory alloy foil adapted to be heated by means of electric current to vary the geometry of the blade.

In a first embodiment of the invention, the composite structure of each blade includes a matrix made of thermosetting or thermoplastic polymer material, possibly reinforced with fibres, incorporated inside which is the shape memory alloy foil.

According to a first variant, the composite structure includes two polymer material sheets interposed and adhering between which is the shape memory alloy foil.

According to a further variant, the composite structure is a laminated structure comprising a series of polymer material sheets inserted and adhering between which is the shape memory alloy foil.

According to a further and currently preferred variant, the composite structure includes a polymer material sheet made in its thickness with cavities inside which respective shape memory alloy foils are inserted.

Furthermore, the invention has the object of a method for manufacturing blades for the variable geometry fan.

BRIEF DESCRIPTION OF THE DRAWINGS

Now, the invention shall be described in detail with reference to the attached drawings, strictly provided for exemplifying and non-limiting purposes, wherein.

DETAILED DESCRIPTION OF THE INVENTION

As stated in the above, the invention particularly regards a fan for cooling internal combustion engines of farm machinery and earth moving machines required in which, in a command-controllable manner and for short operation intervals, is an inversion of the airflow generated by the fan, maintaining its direction and speed of rotation unaltered.

Figure 1:
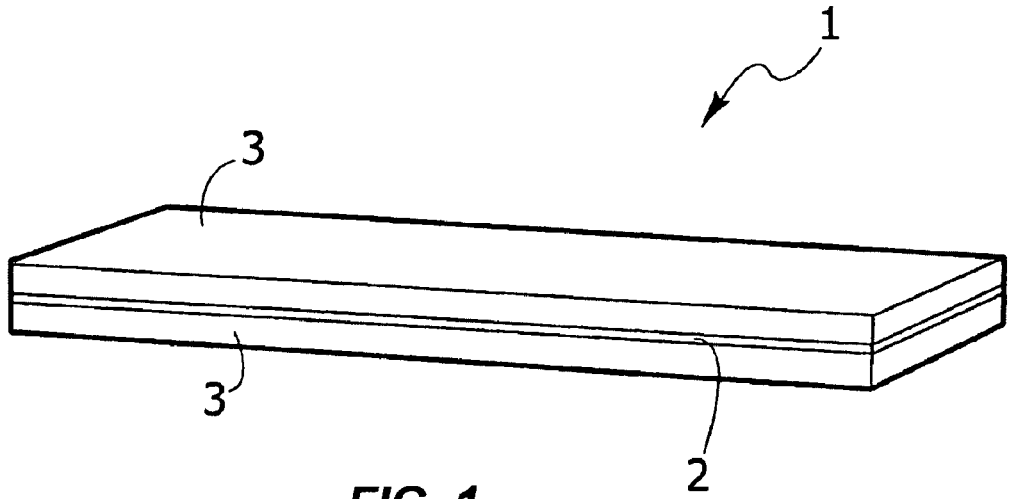
FIG. 1 is a schematic perspective view showing a first example of embodiment of one of the blades of the variable geometry fan according to the invention, represented in an initial undeformed configuration during the manufacturing process thereof.
Figure 2:
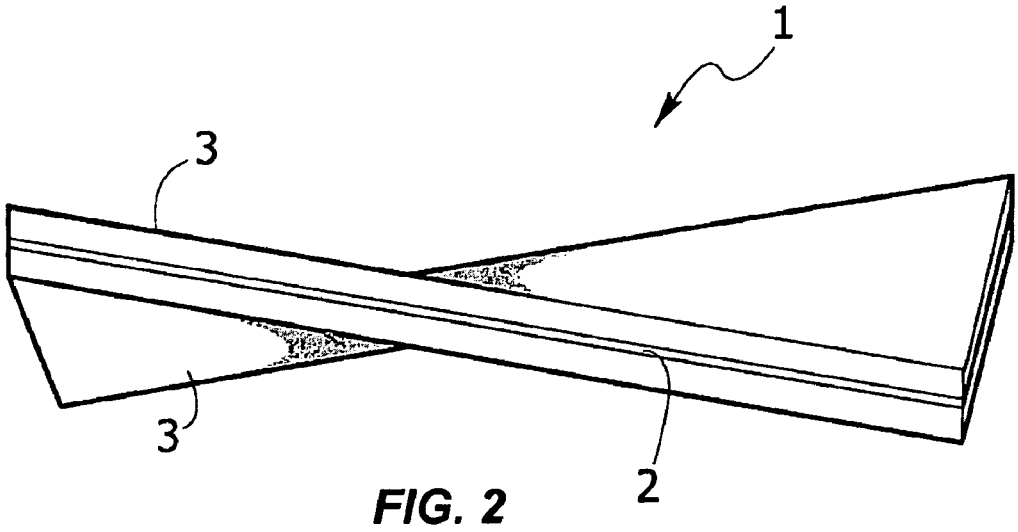
FIG. 2 is a view analogous to FIG. 1 showing the blade in a deformed configuration.

The fan comprises, in a per se known manner and thus not illustrated in detail, a hub which defines the rotational axis of the fan and bears a crown of blades, one of which is represented in FIGS. 1 and 2, respectively in an initial undeformed configuration and in a deformed configuration.

The blade, indicated in its entirety by 1 in the figure, is illustrated schematically in a generally rectangular elementary geometric shape: it should however be observed that the blade shall be normally shaped with specific profiles suitably studied in order to maximise their fluid dynamic efficiency.

According to the distinctive characteristic of the invention, each blade 1 of the fan has an elastically deformable composite structure including a matrix made of thermosetting or thermoplastic polymer material, possibly reinforced with fibres, and at least one shape memory metal alloy foil, typically a NiTi-based alloy.

In the case of the example illustrated in FIGS. 1 and 2 the shape memory alloy foil, indicated with 2, is only one and it is interposed between two thin sheets, made of such polymer material, indicated with 3, hence the blade 1 has a "sandwich" structure in its entirety. Between the shape memory foil 2 and the polymer sheets 3, all of which have a substantially equivalent extension, maximum adhesion shall be ensured for the transfer of stresses and hence of the deformations between the components of the composite structure.

Such composite structure of the blade 1 may alternatively also have different configurations not illustrated in detail.

For example, according to a first variant, the composite structure may be made by incorporating the shape memory alloy foil 2 into a matrix made of thermosetting polymer material, then subjected to a curing process, or made of thermoplastic polymer material. In both cases the matrix is possibly reinforced with fibres.

In a second variant, the blade 1 may have a laminated structure made up of several thermosetting polymer sheets, possibly reinforced with suitably oriented fibres, inserted between which is the shape memory foil 2.

According to further variants, provided for can be several shape memory foils, possibly arranged in preset zones of the blade, for example at its free end.

Due to this configuration, the geometry of each of the blades 1 making up the fan according to the invention may be actively controlled by exploiting the properties of the material of which the foil 2 is made, without requiring complex mechanical devices i.e. fluid-based, by simply varying its temperature through the passage of electric current supplied thereto by means of methods known to a man skilled in the art.

As a matter of fact, the shape memory alloy foil 2 is subjected—due to the temperature variation—to an austenitic-martensitic phase transition (martensitic=stable phase at low temperature; austenitic=stable phase at high temperature).

In the fan manufacturing method according to the invention, before making the composite structure of each blade 1, as described above, the relative shape memory foil 2 is subjected to a particular thermomechanical treatment in advance in such a manner to impart a general helix or a differently flexional or torsional-flexional twisted shape thereto, such shape being "remembered" in the high temperature austenitic phase.

This thermomechanical treatment provides for, starting from an initial undeformed configuration, a step for deforming the foil 2 according to a final preset configuration, a subsequent step for heating at an austenitic temperature and then a final step for cooling below the final temperature of martensitic transformation, returning the foil 2 to the initial configuration.

The foil 2 thus returned to the initial configuration, for example generally flat as schematically illustrated in FIG. 1, is then incorporated inside the thermosetting polymer matrix, i.e. arranged between the polymer sheets according the configurations described above regarding the relative composite structure. Such structure is then subjected to a curing treatment at a suitable temperature to confer the polymer matrix the suitable mechanical and resistance characteristics.

The effect of a passage of suitably controlled electric current, through the shape memory foil 2, determines its heating due to the Joule above the transformation temperature. The consequent transformation of the martensitic-austenitic phase leads to the passage of the foil to the final configuration, for example helix-shaped, memorised in the manner explained above with preliminary thermomechanical treatment. The recovery of the final shape generates an elastic deformation of the entire structure and thus of the blade 1, in the manner represented in FIG. 2.

Through a suitable dimensioning of the system, the command-controllable variation of the geometry of the fan blades may generate the nullification or even the inversion of the generated airflow.

Upon cutting off the power supply, the shape memory foil 2 of each blade 1 cools, with the consequent martensitic transformation. The elastic return of the polymer material to the composite structure thus allows each blade 1 of the fan to reacquire the initial undeformed configuration, simultaneously and automatically preloading the shape memory foil 2. At this point, the fan is ready for the subsequent activation.

Instead of exploiting the elastic return of the polymer material of the composite structure, i.e. additionally to the same, it can also be provided for that the shape memory foil 2 be subjected to a two-way treatment, i.e. by memorising its initial undeformed configuration through a proper well known thermal-mechanical process.

The system for simultaneous power supply to the fan blades is attainable in a particularly easy and inexpensive manner, in such a manner to exploit the aforedescribed treatment performed in advance on the shape memory foils of the blades to generate the deformation of the entire fan structure. Through a suitable modulation of the power supply, constant adjustment of the geometric variation of the blades and thus of the fan in its entirety can be obtained, hence optimising energy efficiency.

Figure 3:
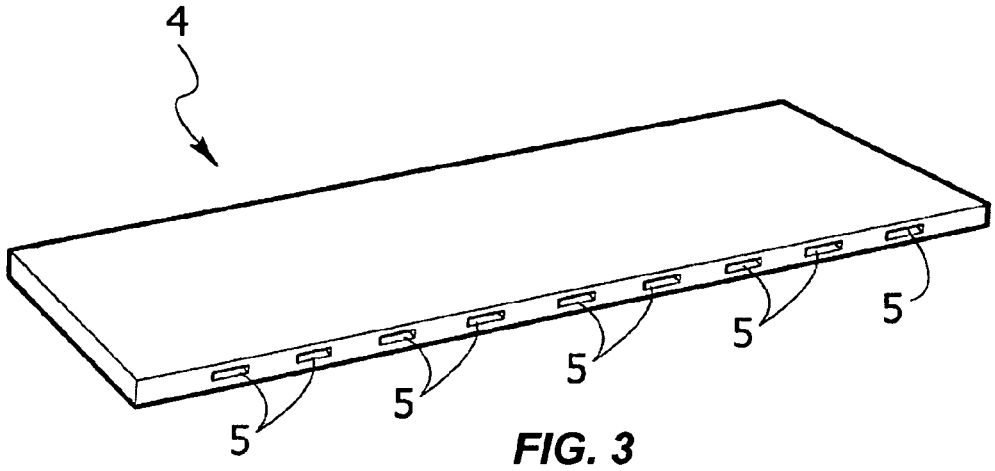
FIG. 3 shows a variant of the blade according to the invention represented in a step of the manufacturing process thereof.
Figure 4:
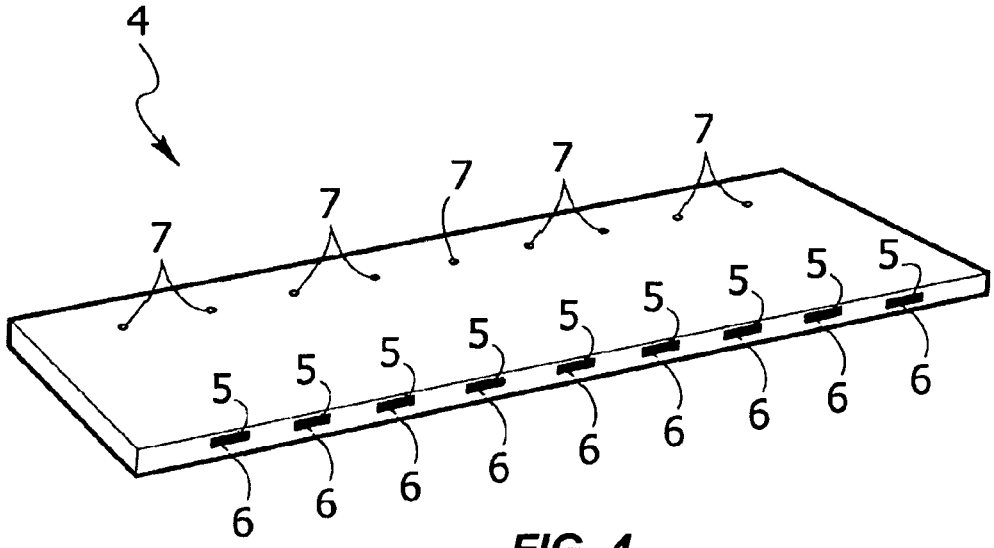
FIG. 4 shows the blade of FIG. 3, in an undeformed state, at the end of the manufacturing process thereof.

A further variant of the blade according to the invention is represented in FIGS. 3 and 4.

In this variant, the composite structure includes a polymer material sheet 4 made in its thickness with cavities 5 inserted inside which are the respective shape memory alloy foils 6. The cavities 5 are typically extended into configurations spaced in a parallel manner in the direction of the width of the polymer material sheet 4, and the shape memory alloy foils 6 are made up of bars fitted into the cavities 5.

Preferably, the cavities 5 are closed at one end, in a pocket-like manner, and each shape memory alloy bar 6 is rigidly connected to the sheet 4 only in proximity to the closed end of the respective cavity 5, where schematically indicated with 7, through any suitable means (nailing, gluing, welding etc).

The blade manufacturing process according to FIGS. 3 and 4 and the relative operation is as follows.

1) The sheet 4 is generated by injecting thermoplastic resin (ex: Nylon) into a suitable mould. The mould performs the insertion of the cores to create the pockets 5 directly on the casting, upon completion of the resin polymerisation. (FIG. 3)
2) Upon extraction of the sheet 4 from the mould, accommodated inside such pockets 5 are NiTi. foils or bars 6 (FIG. 4)
3) A thermomechanical treatment was performed on the foils 6, inserted into the pockets 5 after being predeformed in a generally flat shape, in such a manner to memorise a generally parabolic shape at a high temperature in the austenitic phase.
4) The foils 6 are then constrained to the polymer matrix of the sheet 4 through a rigid constraint only at one end, thus they are free to slide over the remaining length.
5) Upon thermal activation of the foils 6, the latter shall remember the general parabolic shape memorised in advance and generate a macroscopic deformation of the entire blade.
6) Upon elimination of the thermal activation, the rigidness of the polymer matrix 4 elastically returns the blade to the initial configuration, simultaneously predeforming the NiTi foils 6. At this point, the system is ready for a new actuation.

Figure 5:
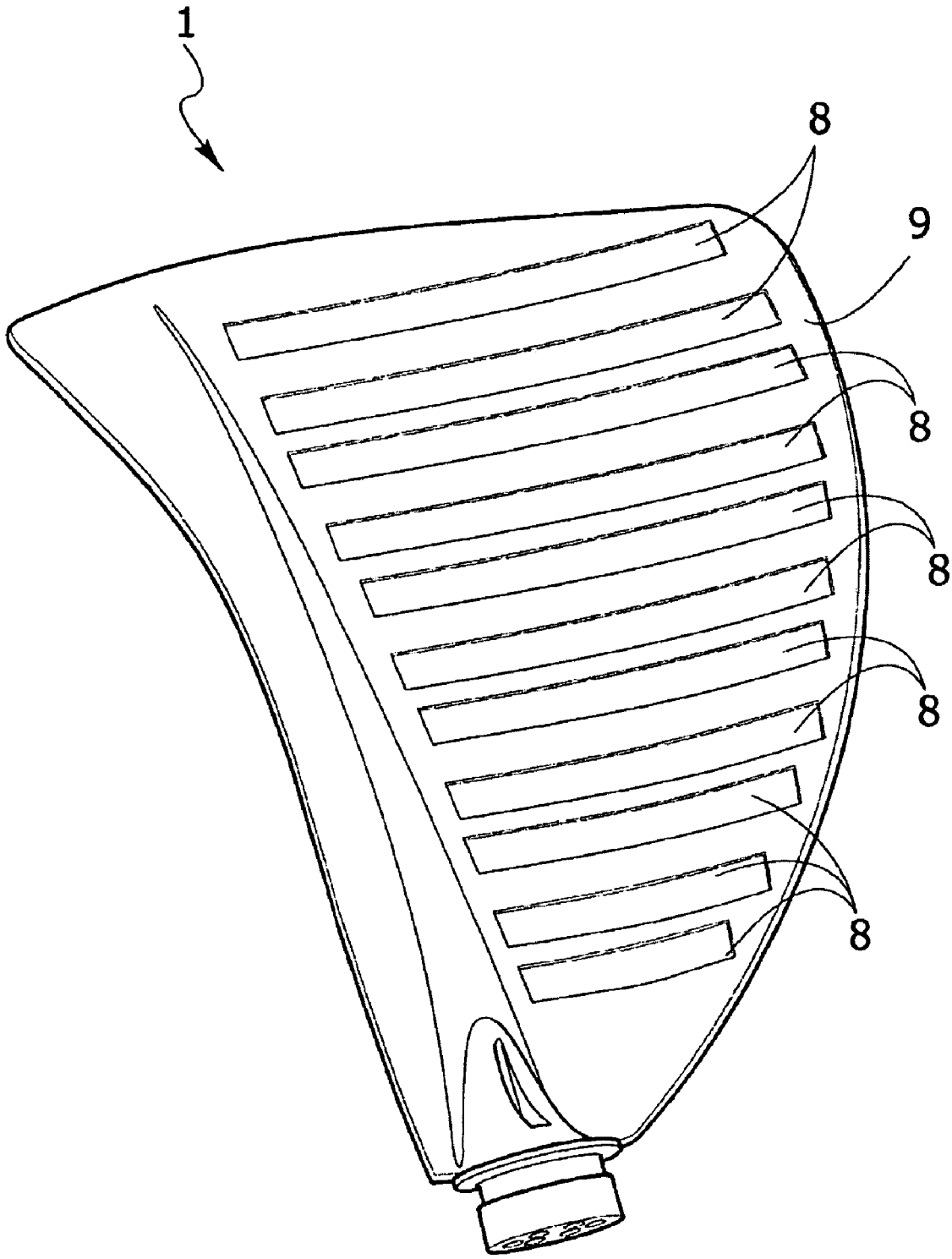
FIG. 5 is a front elevational view of a further variant of the invention shown in an intermediate step of the manufacturing process thereof.
Figure 6:
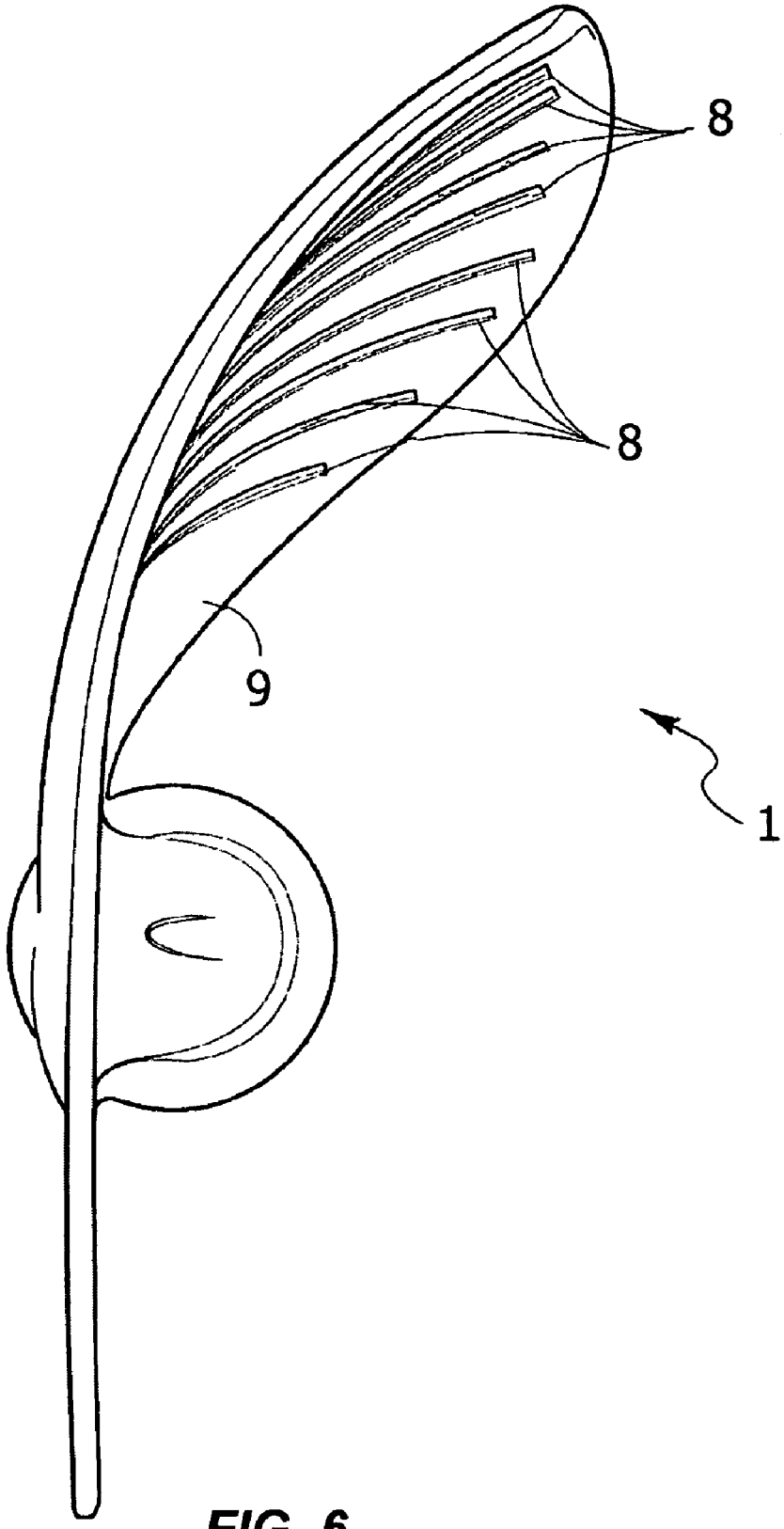
FIG. 6 is a lateral elevational view of FIG. 5.

In the further variant depicted in FIGS. 5 and 6, which is currently considered to be the preferred embodiment, the cavities for the shape memory alloy foils 6 are formed as notches or recesses 8 open on one face of the polymer sheet referenced as 9 and shown in a twisted condition. Following positioning of the foils 6 (not shown) and their electrical connections to the electrical supply source, the recesses 8 are then closed by applying and securing to sheet 9 a second polymer sheet (not shown), possibly having a reduced thickness, so as to provide an final construction generally corresponding to that shown in FIG. 4 with the only difference that the recesses 8 are then completely closed and, therefore, the foils 6 need not to be further mechanically fixed to the polymeric matrix. It is only necessary that each shape memory alloy foil 6 completely fills the respective recess 8, since in that case the force required to deform the blade structure, following electrical activation of the foils 6, will be applied thereby against the walls of the recesses 8. If necessary, the polymeric matrix shall be provided with a secured or reinforced edge, as depicted in FIG. 5.

Basically, the variant of FIGS. 3, 4 and more particularly the preferred embodiment of FIGS. 5, 6 represent an alternative solution with respect to those described previously wherein the metal/polymer adhesion is not exploited, but only the memorisation on the NiTi foils of a determined shape is used. This instantly leaves room for the possibility to also use the thermoplastic resin, as well as thermosetting resin, for the polymer matrix and makes the industrialisation and manufacture of the blade according to the invention quicker.

Obviously, the construction details and the embodiments may widely vary with respect to the description and illustration provided above, without for this reason departing from the scope of the present invention as defined in the following claims.

What is claimed is:

1. Variable geometry fan, particularly for cooling an internal combustion engine for earth moving machines, comprising a plurality of blades with variable configuration, rotatable around a rotation axis, wherein said blades each have an elastically deformable composite structure including at least one shape memory alloy foil adapted to be heated by means of electric current to vary the geometry of the blades.

2. Fan according to claim 1, wherein said composite structure includes a polymer material matrix, said at least one shape memory foil incorporated within said matrix.

3. Fan according to claim 2, wherein said matrix includes reinforced fibres.

4. Fan according to claim 1, wherein said composite structure includes two polymer material sheets, said at least one shape memory foil interposed and adhering between said sheets.

5. Fan according to claim 4, wherein said shape memory foil consists of one foil and said foil extends substantially equivalent to that of said two polymer material sheets.

6. Fan according to claim 1, wherein said composite structure includes a polymer material sheet having cavities made in its thickness said shape memory alloy foils located in said cavities.

7. Fan according to claim 6, wherein said cavities are extended in a configuration spaced in a parallel manner in the direction of the width of said polymer material sheet and said shape memory alloy foils are made up of bars.

8. Fan according to claim 7, wherein said cavities are closed at one end and said shape memory alloy bars are rigidly connected to said polymer material sheet only in proximity to said end.

9. Fan according to claim 7, wherein said cavities consist of recesses closed at both ends and arranged on one face of said polymer material matrix, and said shape memory foils are fitted and restrained within said recesses by an auxiliary polymer material matrix secured to said face of said polymer material matrix.

10. Fan according to claim 1, wherein said composite structure is a laminated structure comprising a series of polymer material sheets inserted and adhering between which is said at least one shape memory foil.

11. Fan according to claim 1, wherein the material of said shape memory foil is a NiTi-based alloy.

12. Method for manufacturing a fan blade particularly for cooling an internal combustion engine for earth moving machines, comprising a plurality of blades with variable configuration, rotatable around a rotation axis, said blades each having an elastically deformable composite structure including at least one shape memory alloy foil adapted to be heated by means of electric current to vary the geometry of the blades, wherein prior to forming said composite structure, said at least one shape memory alloy foil is subjected, starting from an initial undeformed configuration, to a thermo-mechanical treatment consisting of deforming it according to a final preset configuration, heating it at an austenitic temperature and then cooling it below the final temperature of martensitic transformation, returning the foil to said initial configuration.

13. Method according to claim 12, consisting of a two-way treatment including a step of memorising an initial undeformed configuration of said at least one shape memory alloy foil.

* * * * *